United States Patent [19]

Sieghartner

[11] 4,248,571

[45] * Feb. 3, 1981

[54] CENTRIFUGAL IMPELLERS

[75] Inventor: Leonard J. Sieghartner, Coal Valley, Ill.

[73] Assignee: Roy E. Roth Company, Rock Island, Ill.

[ * ] Notice: The portion of the term of this patent subsequent to Dec. 11, 1996, has been disclaimed.

[21] Appl. No.: 941,019

[22] Filed: Sep. 11, 1978

[51] Int. Cl.³ ..... F04D 13/12; F04D 24/18

[52] U.S. Cl. ..... 416/175; 416/186 A; 416/189; 415/143; 415/DIG. 3

[58] Field of Search ..... 415/91, 122 A, 143, 415/199.6, 213 R, 213 B, 213 C, DIG. 3; 416/175, 179, 186 R, 186 A, 187, 189 R, 191

[56] References Cited

U.S. PATENT DOCUMENTS 4,178,131 12/1979 Sieghartner ..... 416/175

*Primary Examiner*—Leonard E. Smith

*Attorney, Agent, or Firm*—Emrich, Root, Lee, Brown & Hill

[57] ABSTRACT

A centrifugal impeller for use in a combination centrifugal-turbine pump capable of pumping liquids at or near the boiling point thereof with suction heads not greater than about one foot and wherein the entrance portion of the centrifugal impeller includes a plurality of vane inserts removably mounted therein, with adjacent ones of the inserts having vanes that are aligned with each other to define liquid-feeding spiral vanes that extend through the plurality of inserts.

8 Claims, 3 Drawing Figures

CENTRIFUGAL IMPELLERS

BACKGROUND OF THE INVENTION

This invention relates to combination centrifugal-turbine pumps, and, more particularly to centrifual impellers for use in centrifugal-turbine pumps.

It is a primary object of the present invention to afford a novel centrifugal impeller for use in combination centrifugal-turbine pumps.

Centrifugal-turbine pumps for pumping liquids at or near the boiling point with suction heads not greater than about one foot having been heretofore known in the art, being disclosed, for example, in U.S. Pat. No. 2,875,698, issued to L. C. Roth, in my earlier U.S. Pat. No. 3,614,256 and in my earlier filed application for United States Letters Patent, Ser. No. 167,988, filed Aug. 2, 1971, now abandoned. It is another object of the present invention to afford improvements over combination centrifugal-turbine pumps heretofore known in the art.

Centrifugal impellers for use in centrifugal-turbine pumps, and which impellers embody vanes in the entrance portion thereof have been heretofore known in the art, being shown, for example, in my aforementioned application, Ser. No. 167,988 and in U.S. Patent No. 2,902,941, issued to Y. Kiba, U.S. Pat. No. 2,984,189, issued to W. K. Jekat and U.S. Pat. No. 3,221,661, issued to J. S. Swearingen. It is a further object of the present invention to afford improvements over centrifugal impellers heretofore known in the art.

Centrifugal impellers for use in centrifugal-turbine pumps, and which embody vane inserts mounted therein and secured thereto such as, for example, by welding have been heretofore known in the art, being shown, for example, in the aforementioned Jekat U.S. Pat. No. 2,984,189. It is another object of the present invention to afford improvements over centrifugal impellers heretofore known in the art which embodied such vane inserts.

Centrifugal impellers for use in centrifugal-turbine pumps, and which embody vane inserts removably mounted therein have been heretofore known in the art, being shown, for example, in my earlier filed, co-pending application for United States Letters Patent, Ser. No. 931,481, filed Aug. 7, 1978, and now issued as U.S. Pat. No. 4,178,131. The vane inserts of the centrifugal impellers of my last mentioned application for Letters Patent, embody central hubs disposed in substantially concentric relation to outer peripheral flange portions, with the vanes of the impellers extending between the hub and flange of the respective impeller. While impellers of the last mentioned type have been highly successful, it is an important object of the present invention to afford improvements thereover.

Another object of the present invention is to afford a novel centrifugal impeller for use in centrifugal-turbine pumps embodying vanes constituted and arranged in a novel and expeditious manner in the entrance portion of the impeller.

Another object is to enable the vane portion of such an impeller to be manufactured in a novel and expeditious manner.

Yet another object of the present invention is to afford a novel centrifugal impeller of the aforementioned type wherein the vanes are afforded in one or more novel inserts mounted in the impeller in a novel and expeditious manner.

A further object of the present invention is to afford a novel centrifugal impeller of the aforementioned type which is practical and efficient in operation, and which may be readily and economically produced commercially.

Other and further objects of the present invention will be apparent from the following description and claims and are illustrated in the accompanying drawing which, by way of illustration, show the preferred embodiment of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENT SHOWN HEREIN

Figure 1:
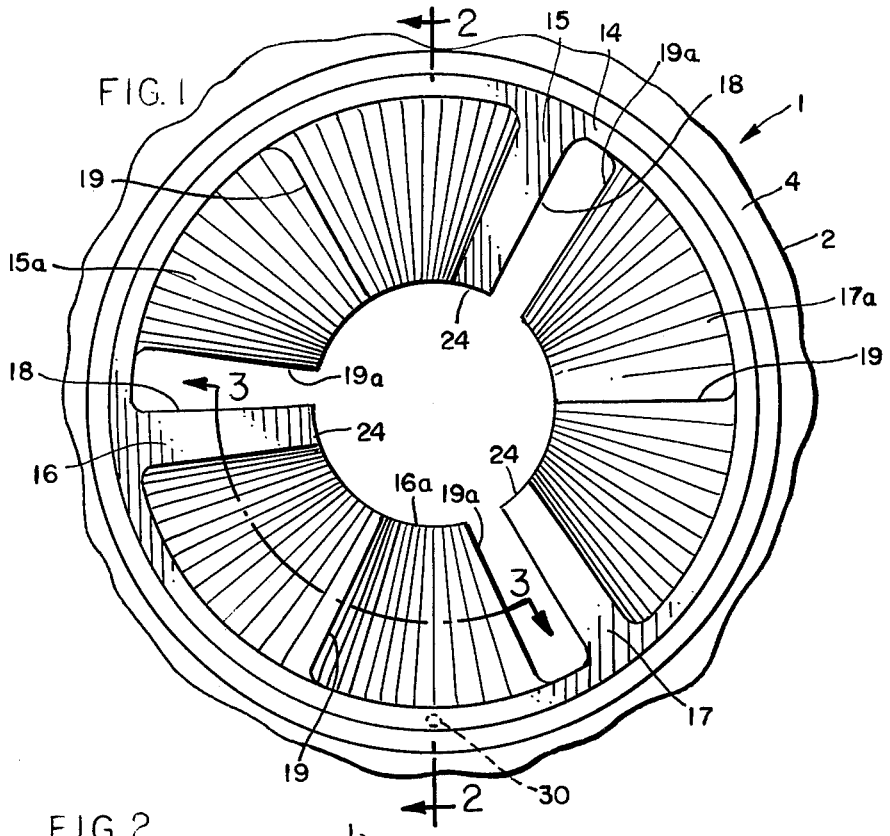
FIG. 1 is a fragmentary front elevational view of a centrifugal impeller embodying the principles of the present invention.
Figure 2:
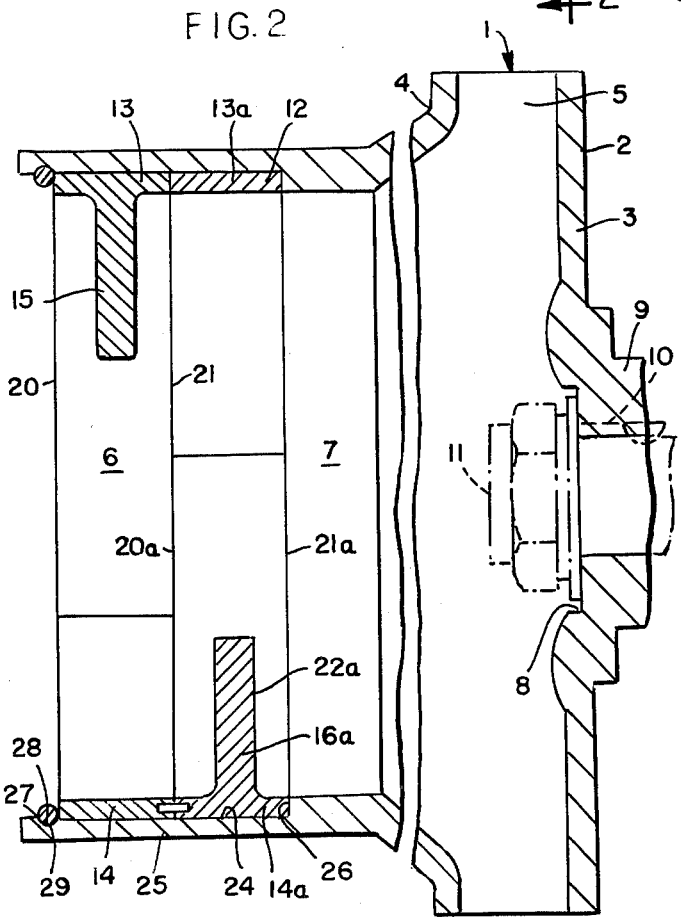
FIG. 2 is a cross sectional view taken substantially along the line in 2—2 in FIG. 1.
Figure 3:
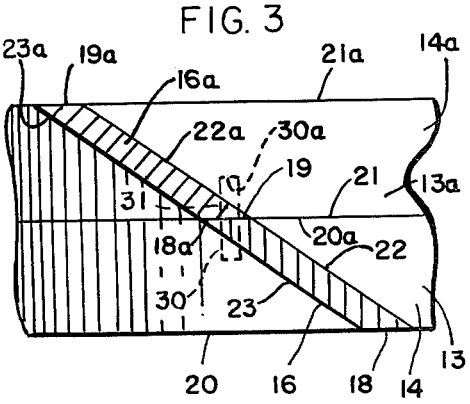
FIG. 3 is a detail sectional view taken substantially along the line 3—3 in FIG. 1.

A centrifugal impeller 1, embodying the principles of the present invention, is shown in FIGS. 1–3 of the drawings to illustrate the presently preferred embodiment of the present invention. The impeller 1 is of the same general type as the centrifugal impeller shown in my aforementioned U.S. Pat. No. 3,614,256, although it differs therefrom. Like the centrifugal impeller shown in the last mentioned patent, the impeller 1 embodies a one-piece housing 2 having a rear wall 3 and a front wall 4 defining discharge passageways 5, and with an entrance portion in the form of an elongated tubular member 6, which is integral with the front wall 4 and preferably is substantially round in transverse cross section, projecting forwardly from the front wall 4 to afford an entrance opening 7 for the impeller 1. The rear wall 3 has an opening 8 extending therethrough, and a cylindrical or tubular hub 9, which is integral with the rear wall 3, projects rearwardly therefrom in axial alignment with the opening 8, FIG. 2. The hub 9 has a key way 10 formed therein for keying housing 2, in a manner well-known in the art, to a drive shaft, such as the drive shaft 11 shown in broken lines in FIG. 2, of a suitable pump, such as the pump shown in my aforementioned U.S. Pat. No. 3,914,256, the remainder of the pump not being shown herein.

The impeller 1, also, is of the same general type as the centrifugal impeller shown in my aforementioned co-pending application for United States Letters Patent, Ser. No. 931,481, although it differs therefrom, as will be discussed in greater detail hereinafter. Like the impeller shown in my aforementioned co-pending patent application, the impeller 1 includes a vane assembly 12, FIG. 2, embodying two vane inserts 13 and **13*a*, the vane assembly 12 being mounted in the entrance opening 7 of the impeller 1. Unlike the impeller shown in my aforementioned co-pending patent application, the vane inserts 13 and 13***a* do not embody a central hub portion.

The vane insert 13 embodies an outer annular flange 14, with three equally spaced vanes 15, 16 and 17 extending radially inwardly from the inner face of the flange 14.

Each of the vanes 15–17 extends across the entire width of the flange 14, terminating at its front and rear edge portions 18 and 19, respectively, in uniplanar relation to the front face 20 and the rear face 21, respectively, of the vane insert 13, FIG. 3. Each of the vanes 15–17 embodies a front face 22 and a rear face 23 and is so disposed on the flange 14 that the front face 22 thereof is disposed at a rearwardly opening obtuse angle to the front face 20 of the vane insert 13, FIG. 3. It will be remembered that the vanes 15–17 project radially inwardly from the flange 14, and, as may be seen in FIG. 1, they terminate at their respective inner ends 24 radially outwardly of the axis of rotation of the housing 2 on the periphery of a circle which is concentric to the flange 14.

The vane insert 13*a* is identical in construction to vane insert 13, except for the positioning of an opening therein, as will be discussed in greater detail presently, and parts thereof are indicated in the drawing by the same reference numerals as those used to indicate parts of the vane insert 13, but with a suffix "a" added thereto.

The tubular member 6 of the housing 2 has an annular recess 24 formed therein in the interior of the front end portion 25 thereof, FIG. 2. The recess 24 terminates at its inner end in a shoulder 26, and has a snap-ring groove 27 formed around the interior of the outer end portion thereof for a purpose which will be discussed in greater detail presently.

The recess 24 is of such circumferential size that it will receive the vane inserts 13 and 13*a* therein with a press fit; and is of such depth that when the vane inserts 13 and 13*a* are disposed therein in side-by-side, or laterally stacked relation to each other, with the rear face 21*a* of the vane insert 13*a* disposed in abutting engagement with the shoulder 26, a snap-ring, such as the snap-ring 28, shown in FIG. 2, when disposed in the groove 27, is effective to insure that the vane inserts 13 and 13*a* are held in the recess 24 in abutting engagement with each other. Openings, such as the opening 29, FIG. 2, may be afforded through the front end portion 25 of the tubular member 6, in radial alignment with the snap-ring groove 27 so that a suitable tool may be inserted therethrough to dislodge the snap-ring 28 from the groove 27 when it is desired to remove the vane inserts 13 and 13*a* from the recess 24.

When the vane inserts 13 and 13*a* are disposed in operative position in the recess 24, the forward edge portion 18*a* of each of the vanes 15*a*–17*a* of the vane insert 13*a* is disposed directly rearwardly of, and in closely adjacent, parallel relation to the rear edge portion 19 of each of the vanes 15–17, respectively, of the vane insert 13. With the vane inserts 13 and 13*a* so disposed relative to each other, the vanes 15–17 in the vane insert 13 are aligned with each of the vanes 15*a*–17*a*, respectively, of the vane insert 13*a* in such a manner that each pair of thus aligned vanes affords a spiral-shaped vane extending inwardly from the front edge of the tubular member 6 toward the rear wall 3 of the housing 2, so that when the impeller 1 is mounted in a combination centrifugal-turbine pump and is rotated in a clockwise direction, as viewed in FIG. 1, the front face 22–22*a* ease the liquid entering the entrance 7 of the impeller 1 into a rotational movement by virtue of the turning of the spiral vanes 15–15*a*, 16–16*a* and 17–17*a*, as the liquid passes toward the rear wall of the housing 2, and, in addition, imparts an axial velocity to the liquid and increases its pressure. By virtue of the vanes being attached to rotating flange 14 there is no back leakage as the pressure increases. These forces combine to prevent the high rotational velocity of the rearward portion of the impeller 1 from causing the liquid to flash into vapor. The liquid entering the rear portion of the housing 2 of the impeller 1, from the entrance portion 7 thereof, is discharged therefrom through the passageways 5 in the usual manner.

In the preferred embodiment of the present invention, openings 30 and 30*a* are formed in the rear face 21 of the flange 14 and the front face 20*a* of the flange 14*a*, respectively, FIG. 3, in such position that by aligning the openings 30 and 30*a*, and disposing a pin 31 therein, the vane inserts 13 and 13*a* are automatically disposed in such position relative to each other that the vanes 15–17 of the vane insert 13 are properly aligned with the vanes 15*a*–17*a*, respectively, of the vane insert 13*a*. This, of course, means that for the vane inserts 13 and 13*a*, the opening 30*a* is offset to the right, or in a clockwise direction, as viewed in FIG. 1, with respect to the opening 30 in the vane insert 13 the same amount that the vane insert 13*a* is offset in a counter-clockwise direction relative to the vane insert 13 when the vane inserts 13 and 13*a* are disposed in the aforementioned operative position to each other in the tubular member 6. With this construction, it will be seen that the vane inserts 13 and 13*a* may be quickly and easily properly positioned relative to each other, and may be quickly and easily positioned, as a unit, in the tubular member 6 of the housing 2.

Impeller inserts embodying three vanes, FIGS. 1–3, are shown herein only by way of illustration and not by way of limitation of the broader aspects of the present invention. A greater or lesser number of vanes may be used in the individual impeller inserts and a greater or lesser number of impeller inserts may be used in the manner disclosed herein without departing from the broader aspects of the present invention. The manner of the number of vanes used in the impeller inserts and the matter of the number of impeller inserts to be used depends upon various factors, such as, for example, the fluid flow desired through the assembled unit, the rotational velocity and the axial thrust which it is desired to impart to the fluid, the speed or rotation of the centrifugal impeller, and the like.

However, in the practice of the present invention in accordance with the preferred form thereof, the leading and rear edges of the individual vanes in the individual impeller inserts will, in all instances, be spaced from the rear and leading edges, respectively, of the next adjacent vanes of that insert, so as to facilitate the manufacture of the vane inserts. As will be appreciated by those skilled in the art, with the vane inserts constructed in such a manner, with the individual vanes so spaced from each other and of relatively short length in an annular direction relative to the respective inserts in which they are embodied, the inserts may be readily manufactured by such means as, for example, by casting without internal cores.

From the foregoing, it will be seen that the present invention affords a novel centrifugal impeller for use in a combination centrifugal-turbine pump.

Also, it will be seen that the present invention affords a novel impeller of the aforementioned type, which embodies vanes constituted and arranged in a novel and expeditious manner in the entrance portion thereof.

In addition, it will be seen that the present invention affords a novel impeller of the aforementioned type wherein the vanes may be readily manufactured and with an ease not heretofore known in the art.

Further, it will be seen that the present invention affords a novel centrifugal impeller which is practical and efficient in operation and which may be readily and economically produced commercially.

Thus, while I have illustrated and described the preferred embodiment of my invention, it is to be understood that this is capable of variation and modification, and I therefore, do not wish to be limited to the precise details set forth, but desire to avail myself of such changes and alterations as fall within the purview of the following claims.

I claim:

1. In a centrifugal impeller for use in a centrifugal-turbine pump capable of pumping liquids at or near the boiling point thereof with suction heads not greater than about one foot, the impeller including a housing having a front, elongated entrance portion through which such liquid enters said housing, and a rear discharge portion from which liquid entering said housing through said discharge portion is discharged from said housing during operation of said pump, and said pump including drive means including a drive shaft mounted in said housing and operatively connected thereto for rotating the latter, the combination of:

a. vane means removably mounted in said entrance portion for rotation therewith for feeding such liquid through said entrance portion to said discharge portion during such rotation of said housing with said drive shaft, b. said vane means comprising
  (1) a vane insert comprising
    (a) an outer annular flange, and
    (b) a plurality of vanes projecting substantially radially inwardly from said flange in annularly spaced relation to each other, c. said vane insert being mounted in said entrance portion for rotation therewith, with the outer peripheral surface of said flange being disposed in closely adjacent relation to the inner surface of said entrance portion, and d. said flange having
  (1) a front face through which such liquid enters in entering into said entrance portion, and
  (2) a rear face through which said liquid exits in flowing through said entrance portion to said discharge portion, and e. each of said vanes having a front face,
  (1) facing in the direction of rotation of said impeller insert when the latter is so rotating with said drive shaft, and
  (2) disposed at a rearwardly opening obtuse angle to said front face of said flange.

2. A centrifugal impeller for use in a combination centrifugal-turbine pump capable of pumping liquids at or near the boiling point thereof with suction heads not greater than about one foot and having a drive shaft rotatable therein during operation of said pump, said impeller comprising:

a. a housing adapted to be mounted on and secured to such a drive shaft for rotation therewith and comprising
  (1) a front tubular entrance portion for feeding such liquid into said housing, and
  (2) a rear portion having discharge passageways therein for discharging such liquid from said housing, b. a vane assembly comprising a plurality of vane inserts removably mounted in said entrance portion, c. each of said vane inserts comprising
  (1) an outer annular flange, and
  (2) a plurality of vanes extending substantially radially inwardly from said flange, d. each of said flanges having a front face and a rear face defining the respective, axially spaced, opposite sides thereof, e. each of said vanes in each of said vanes inserts
  (1) extending between said front face and said rear face of said flange in said insert,
  (2) having
    (a) a front face disposed at an obtuse angle to said front face of said last mentioned flange,
    (b) a rear face disposed at an acute angle to said last mentioned front face,
    (c) a front edge disposed adjacent to said front face of said last mentioned flange, and
    (d) a rear edge disposed adjacent to said rear face of said last mentioned flange, f. said vane inserts being mounted in said entrance portion in side-by-side relation to each other, with
  (1) the outer peripheries of said flanges thereof disposed in closely adjacent relation to the inner peripheral surface of said entrance portion,
  (2) said front faces of said vanes thereof facing in the direction of rotation of said inserts when the latter are so rotated with said entrance portions, and
  (3) said rear edges of said vanes of each of said vane inserts, which is disposed adjacent to a vane insert in the direction toward said rear portion of said housing, are aligned with said front edges of respective ones of said vanes of said vane insert, which is so adjacent, in adjacent, parallel relation thereto, and g. means for releasably holding said vane inserts in said housing for rotation therewith.

3. A centrifugal impeller as defined in claim 2, and in which a. said means for releasably holding said vane inserts in said entrance portion comprises
  (1) a recess formed in the interior of said entrance portion at the end thereof remote from said rear portion for receiving said vane inserts therein,
  (2) a shoulder defining the inner end of said recess for limiting movement of said vane inserts into said entrance portion, and
  (3) a snap-ring removably mounted in said recess at the side of the latter remote from said shoulder.

4. A centrifugal impeller as defined in claim 2, and in which a. in each of said impeller inserts said front edges and said rear edges of each of said vanes thereof are spaced annularly around said impeller from said rear and front edges, respectively, of the next adjacent ones of said vanes therein.

5. A centrifugal impeller as defined in claim 4, and in which a. said impeller inserts comprise metal castings.

6. A centrifugal impeller as defined in claim 2, and in which a. each respective set of said aligned respective vanes in said plurality of vane inserts defines a continuous spiral that progresses along said tubular entrance portion toward said rear portion from the end portion of said tubular entrance portion remote from said rear portion.

7. A centrifugal impeller as defined in claim 6, and in which a. said flanges of each adjacent pair of vane inserts have aligned openings therein, and b. a pin is mounted in each adjacent pair of said aligned openings to properly index said adjacent pair of vane inserts relative to each other.

8. A centrifugal impeller as defined in claim 6, and in which a. said vanes in each of said impeller inserts terminate at the edges thereof remote from said flange of the respective impeller insert radially outwardly of the axis of rotation of said impeller insert on a circle which is concentric to said flange of said impeller insert.

* * * * *